US010323196B2

(12) United States Patent
Gunther et al.

(10) Patent No.: US 10,323,196 B2
(45) Date of Patent: Jun. 18, 2019

(54) METHODS AND SYSTEMS FOR PRODUCING GASOLINE FROM LIGHT PARAFFINS

(71) Applicant: ExxonMobil Research and Engineering Company, Annandale, NJ (US)

(72) Inventors: William R. Gunther, Clinton, NJ (US); Christopher G. Smalley, Lanoka Harbor, NJ (US); Brian A. Cunningham, Tokyo (JP); James R. Bielenberg, Lebanon, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 15/911,733

(22) Filed: Mar. 5, 2018

(65) Prior Publication Data

US 2018/0265789 A1 Sep. 20, 2018

Related U.S. Application Data

(60) Provisional application No. 62/472,904, filed on Mar. 17, 2017.

(51) Int. Cl.
*C10G 50/00* (2006.01)
*C10G 57/00* (2006.01)

(52) U.S. Cl.
CPC ..... *C10G 57/005* (2013.01); *C10G 50/00* (2013.01); *C10G 2300/1081* (2013.01); *C10G 2400/02* (2013.01)

(58) Field of Classification Search
CPC ..... C10G 2300/1081; C10G 2400/02; C10G 50/00; C10G 57/005; C07C 2/66; C07C 11/04; C07C 11/06; C07C 4/06; C07C 11/02; C07C 15/02
See application file for complete search history.

(56) References Cited

U.S. PATENT DOCUMENTS

| | | | | |
|---|---|---|---|---|
| 3,974,062 | A | 8/1976 | Owen et al. | |
| 4,016,218 | A | 4/1977 | Haag et al. | |
| 4,035,285 | A | 7/1977 | Owen et al. | |
| 4,840,928 | A | 6/1989 | Harandi et al. | |
| 5,019,353 | A | 5/1991 | Harandi et al. | |
| 5,049,360 | A | 9/1991 | Harandi et al. | |
| 5,164,071 | A | 11/1992 | Harandi | |
| 5,430,211 | A | 7/1995 | Pogue et al. | |
| 5,481,057 | A | 1/1996 | Bell et al. | |
| 6,113,776 | A | 9/2000 | Upson | |
| 6,791,002 | B1 | 9/2004 | Abrevaya et al. | |
| 6,866,771 | B2 | 3/2005 | Lomas et al. | |
| 7,491,315 | B2 | 2/2009 | Eng et al. | |
| 7,611,622 | B2 * | 11/2009 | Niccum | C10G 11/04 208/120.01 |
| 7,902,412 | B2 | 3/2011 | Senetar et al. | |
| 8,124,822 | B2 | 2/2012 | Couch et al. | |
| 2009/0112038 | A1 | 4/2009 | Eng | |
| 2012/0108877 | A1 | 5/2012 | Myers et al. | |
| 2014/0134058 | A1 | 5/2014 | Nicholas et al. | |
| 2014/0135547 | A1 | 5/2014 | Nicholas et al. | |
| 2017/0113981 | A1 * | 4/2017 | Mukherjee | C07C 1/20 |

* cited by examiner

*Primary Examiner* — Sharon Pregler
(74) *Attorney, Agent, or Firm* — Chad A. Guice; Hsin Lin

(57) ABSTRACT

Methods and systems producing gasoline boiling range hydrocarbons from light paraffins are disclosed. Such methods may include exposing a paraffin-containing stream to a catalyst in a side riser of a fluid catalytic cracking reactor under effective conditions for dehydrogenating at least a portion of paraffins in the stream into olefins and thereby producing an olefin-containing stream, wherein the paraffin-containing stream comprises greater than 50 wt % isobutane; and alkylating olefins in the olefin-containing stream to produce a product stream comprising an alkylate fraction comprising hydrocarbons boiling between 100° F. and 400° F.

22 Claims, 1 Drawing Sheet

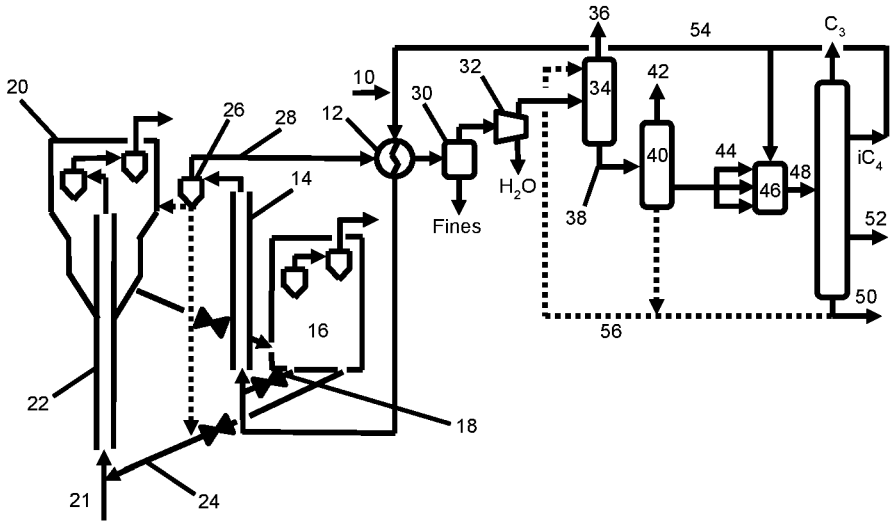
36
54
$C_3$
10
32
42
20
26
28
12
30
34
40
44
48
$iC_4$
14
$H_2O$
46
Fines
38
52
50
16
56
22
18
21
24

METHODS AND SYSTEMS FOR PRODUCING GASOLINE FROM LIGHT PARAFFINS

CROSS-REFERENCE TO RELATED APPLICATIONS

This application claims priority to U.S. Provisional Application Ser. No. 62/472,904 filed Mar. 17, 2017, which is herein incorporated by reference in its entirety.

FIELD

The present application relates to methods and systems for producing gasoline boiling range hydrocarbons from light paraffins.

BACKGROUND

Fluidized catalytic crackers, thermal crackers, and naphtha steam crackers are the main sources of olefins in a refinery. Significant commercial experience exists for cracking naphtha and heavier feeds to olefins, however limited technologies exist for dehydrogenating propane and butane.

The fluid catalytic cracking (FCC) process has become the pre-eminent source for motor gasoline in the USA and also serves the petrochemical industry with light olefins as petrochemical feedstock. Normal FCC operation cracks large molecules to a wide boiling mixture including olefins. The addition of ZSM-5 catalyst can further convert naphtha (gasoline) range olefins into butylenes, propylene and ethylene. Olefins exhibit a maximum yield as a function of ZSM-5 addition due to dilution of the normal FCC cracking catalyst and display a relatively fixed product distribution that favors propylene, with approximately 1.5 additional propylene per butylene.

The base FCC catalyst facilitates hydrogen transfer of olefins to their corresponding paraffin (e.g., isobutylene to isobutane). As main riser temperature is increased, olefin production also increases, but at high temperatures overcracking leads to significant hydrogen transfer and unwanted coke formation.

Butane feeds to steam crackers are typically used for the production of butene-1 and high purity butadiene. Steam crackers co-feed high concentrations of water to suppress coke formation on furnace tubes through reduced hydrocarbon partial pressure and gasification.

There remains a need for methods and systems that can convert light paraffins to gasoline boiling range hydrocarbons.

SUMMARY

In one aspect, a method is provided for producing gasoline boiling range hydrocarbons from light paraffins comprising: exposing a paraffin-containing stream to a catalyst in a side riser of a fluid catalytic cracking reactor under effective conditions for dehydrogenating at least a portion of paraffins in the stream into olefins and thereby producing an olefin-containing stream, wherein the paraffin-containing stream comprises greater than 50 wt % isobutane; and alkylating olefins in the olefin-containing stream, without intermediate separation of unreacted isobutane in the olefin-containing stream, to produce a product stream comprising an alkylate fraction comprising hydrocarbons boiling between 100° F. and 400° F.

In another aspect, a method is provided for producing gasoline boiling range hydrocarbons from light paraffins comprising: exposing a residual fraction to a catalyst in a main riser of a fluid catalytic cracking reactor under first effective conditions to crack hydrocarbons of the residual fraction; exposing a paraffin-containing stream to the catalyst in a side riser of the fluid catalytic cracking reactor under second effective conditions for dehydrogenating at least a portion of paraffins in the stream into olefins and thereby producing an olefin-containing stream, wherein the paraffin-containing stream comprises greater than 50 wt % isobutane; and alkylating olefins in the olefin-containing stream to produce a product stream comprising an alkylate fraction comprising hydrocarbons boiling between 100° F. and 400° F.

DRAWINGS

FIG. 1 is a schematic illustrating a system for producing gasoline boiling range hydrocarbons from paraffins using a side riser of a fluid catalytic cracking unit according to one or more embodiments of the present invention.

DETAILED DESCRIPTION

Disclosed are systems and methods for generating olefins from light paraffins in high yield, which can then be fed into an alkylation unit to make high octane gasoline. Such systems may utilize a second, side riser of a fluid catalytic cracking (FCC) unit having a main riser for cracking a residual or vacuum gas oil feed.

As used herein, and unless specified otherwise, "gasoline" or "gasoline boiling range hydrocarbons" refers to a composition containing at least predominantly $C_5$-$C_{12}$ hydrocarbons. In one embodiment, gasoline or gasoline boiling range components is further defined to refer to a composition containing at least predominantly $C_5$-$C_{12}$ hydrocarbons and further having a boiling range of from about 100° F. to about 400° F. In an alternative embodiment, gasoline or gasoline boiling range components is defined to refer to a composition containing at least predominantly $C_5$-$C_{12}$ hydrocarbons, having a boiling range of from about 100° F. to about 400° F. at about 101.3 KPa absolute, and further defined to meet ASTM standard D439.

As used herein, and unless specified otherwise, "vacuum gas oil" can include one or more $C_{22}$-$C_{52}$ hydrocarbons and boil in the range of about 340 to about 590° C. or about 340 to about 560° C. at about 101.3 KPa absolute. A vacuum gas oil may be a hydrocarbon product of vacuum distillation and be abbreviated herein as "VGO".

The methods and systems disclosed herein may use available heat from catalyst regeneration in a FCC unit to dehydrogenate light paraffins such as butane and propane in a high temperature, short contact time second riser reactor. The second riser may operate in parallel to the primary riser, with each riser receiving regenerated catalyst from the regenerator. Advantageously, such a configuration allows for operation near the catalyst regenerator temperature where olefin production is significant and the high surface area-fluidized catalyst serves as a heat transfer medium for the highly endothermic reaction. In addition, the ability of the side riser to act as a catalyst cooler allows pushing of residual oils into the main riser of the FCC. The low side riser coke loadings allow catalyst feeding directly into the main riser standpipe, enabling higher catalyst circulation rates and conversion at lower temperature.

Furthermore, supplying a feedstream that is predominantly isobutane (e.g., greater than 50 wt % isobutane) to the side riser allows for the preferential dehydrogenation to isobutylene, which is a desirable feed for the alkylation unit, or it can crack to propylene with very low proportions of propane, which is a desirable feed for a chemical plant.

Advantageously, the systems and methods disclosed herein may employ traditional FCC catalysts for the conversion of vacuum gas oils to naphtha. For example, the catalyst may be a bifunctional metal-acid catalyst. In any embodiment, the catalyst may contain Ni and/or V, which catalyzes dehydrogenation, and acid sites, which catalyze cracking. The dual dehydrogenation/cracking functionality may prevent the buildup of unwanted light paraffins in an isobutane recycle from the integrated alkylation unit, and moreover, the presence of a metal functionality inside the zeolite can promote dehydrogenation of light molecules while avoiding coke-forming reactions of heavy molecules in the main riser.

Further advantages may be realized by coupling of the olefin product from the side riser with a downstream alkylation unit. This may allow for reactive separation without direct separation of the primary feed (e.g., butane) from the primary product (e.g., butylene). Unreacted isobutane can function as the isoparaffin in alkylation, thereby doubling per-pass conversion. An intermediary absorption step can remove ethane and lighter molecules while avoiding refrigerated distillation. In any embodiment, the use of alkylate as sponge oil avoids the need for separation from the $C_3$-$C_4$ product before entering the alkylation reactor and leverages the alkylation separation system. This helps prevent molecules from entering the alkylation unit that could poison the catalyst contained therein. This also would avoid the need to boil the $C_3$-$C_4$ stream from the sponge oil and compress and cool the $C_3$-$C_4$ stream to alkylation conditions, which are energy intensive operations. Another embodiment utilizes a heavy paraffinic sponge oil and supercritical phase separation to avoid supplying the latent heat of vaporization.

An exemplary embodiment is illustrated in FIG. 1. Light paraffin feed 10 is fed to a side riser 14 with regenerated catalyst 18 from regenerator 16. The side riser 14 operates under conditions suitable for converting the light paraffin feed to an olefin-containing product. The product stream may be fed to a separator 26, which may be a cyclone separator, to separate catalyst particles from the product stream 28. The separated catalyst particles may be combined with the regenerated catalyst feed 24 which is fed with a vacuum gas oil 21 to the main riser 22 of the FCC 20. Alternatively, the separated catalyst particles may be returned to the regenerator 16. In an embodiment, the solids could be returned to the regenerator 16 while keeping the gas product with trace fines separate. The use of separate outlets avoids subsequent separation of light gas products from $C_5$ ringed compounds, butadiene, and other alkylation poisons as well as heavy gas oil products. In an alternate embodiment, gas out of the top of the separator can enter the headspace of the FCC 20 to utilize the FCC 20 secondary cyclones for fines removal, as the catalyst may not need to be stripped because butanes are less likely to remain adsorbed onto the catalyst particles.

Feeding the separated catalyst particles into the main riser 22 (e.g., by combining the separated particles with the catalyst feed 24), may have the additional advantage of lowering the temperature of the main riser 22 inlet, allowing for higher catalyst circulation rates, and providing more fresh acid sites.

The product stream 28 may be used to preheat feed 10 via heat exchanger 12 before the feed contacts the regenerated catalyst 18. Additional fines may be recovered using a water wash separator 30 followed by a condenser 32 for water removal. Fluids other than water may also be used for fines separation, including hydrocarbon fluids such as heavy oils The product stream 28 may then be fed to one or more separation units for separating hydrocarbon components such as ethane and lighter (including methane and hydrogen) from the product stream. Preferably, the side riser is closely coupled to the alkylation unit with a minimum number of processing and/or separating steps, as it is not necessary to separate the primary reactant from the primary product. For example, as illustrated in FIG. 1, the product stream 28 may be fed to a deethanizer 34 for the separation of ethane and lighter hydrocarbons 36 and yielding a deethanized product stream 38, which includes olefin product and unconverted paraffin, then may be fed to an alkylation unit or may be subjected to further separation. The deethanizer 34 may be an absorption tower utilizing a deethanizer sponge wash, such as recycled alkylate 56 or heavy paraffinic oil, suitable for adsorbing components heavier than ethane. In other embodiments, the deethanizer 34 may be a refrigerated distillation column, such as a cryo-distillation column.

The deethanized product stream 38 may be subjected to further separation to remove propylene 42 in a propylene separator 40. In some embodiments, propylene separator 40 may be omitted to allow propylene to be fed as part of the products to alkylation unit 46. Alkylate, if used as a sponge wash for ethane, may also be separated from the product stream at this stage. Alternatively, the alkylate may be fed as part of the product stream 44 to alkylation unit 46, where the product stream 44 is subjected to conditions for producing an alkylate including gasoline boiling range hydrocarbons. The product of the alkylation 48 may be fed to a separator for separating the alkylate 50, normal butane 52, and isobutane 54. Isobutane 54 may be recycled to the side riser 14 or to the reactor of alkylation unit 46 to maintain the desired isobutane/olefin ratio. Advantageously, in any embodiment, the side riser may operate at approximately 50% conversion rates, which produces a stoichiometric mix of olefin and isoparaffin and renders a recycle stream to the side riser unnecessary.

Paraffin Feed

Various paraffin feeds may be employed in the systems and methods disclosed herein. Preferably, the paraffin feed is a light paraffin feed comprising, in predominant part, $C_2$-$C_4$ paraffins. For example, the paraffin feed may comprise at least 90 wt % $C_2$-$C_4$ paraffins, such as at least 95 wt % $C_2$-$C_4$ paraffins. More particularly, the paraffin feed may comprise at least 90 wt % $C_3$-$C_4$ paraffins, such as at least 95 wt % $C_3$-$C_4$ paraffins. The feed may also contain residual paraffinic components when using the butane feed for solvent extraction of the main FCC feed.

In any embodiment, the paraffin feed may comprise at least 50 wt % $C_4$ paraffins, such as at least 75% $C_4$ paraffins, or at least 80 wt % $C_4$ paraffins, such as at least 90 wt % $C_4$ paraffins. Feeds with such high butane content are particularly advantageous, because butane dehydrogenation requires temperatures close to that of the FCC regenerator, for example, about 1300° F. Such high butane content feeds are also advantageous, because a butylene product from the side riser is a preferred feed for the alkylation unit. In addition, butanes also liquefy at moderate pressure reducing compression demands for the process, while pentanes and heavier feeds can contain rings that adsorb on acid sites of the catalysts. For example, the paraffin feed may comprise at least at least 50 wt % isobutane, such as at least 75 wt % isobutane, or at least 80 wt % isobutane, such as at least 90 wt % isobutane or at least 95 wt % isobutane. Paraffin feeds with such high isobutane content may be preferred because isobutane lacks a direct reaction path to $C_2$ hydrocarbons, and dehydrogenates to isobutylene and cracks to propylene, with a product distribution that favors butylene over propylene. Additionally, the tetrahedral isobutane molecule cannot contain two unsaturations, leading to reduced diolefins, which can act as a poison for the alkylation unit catalyst. Isobutane is preferred, particularly when dehydrogenating isobutane under conditions that produce a product distribution favoring butylene over propylene, as the butylene product is expected to be a better alkylate than propylene for making gasoline (e.g., higher octane, and lower RVP). Isomerization of butane favors isobutane over normal butane and it is possible to use the equilibrium mixture without separation of the normal and isobutane.

FCC Unit

In the FCC unit, a pre-heated high boiling point petroleum feed such as a vacuum gas oil, a residual fraction, or a combination thereof is subjected to a bulk boiling range conversion by contact with a hot, acidic-function catalyst in a specialized process unit. In the main riser of the FCC, which is typically in the form of a tall vertical pipe, the feed comes into contact with the hot catalyst at the bottom of the riser and cracking reactions take place as the feed and catalyst move through the riser to produce a range of cracked hydrocarbon fragments in the vapor phase. Cutting main riser severity results in a shift towards heavier products, reducing dry gas and opening up light gas capacity. Higher matrix catalysts or bottoms recycle can improve bottoms conversion.

The mixture of catalyst, vaporous cracking products and unconverted residues then enters a disengaging zone in which the catalyst is separated from the hydrocarbons, usually by cyclones or other inertial devices. For reasons arising from the early history of the process, the disengaging zone is usually referred to as the "reactor" although the majority of the cracking reactions take place, as intended, in the riser and the intention is that cracking in the reactor itself should be minimized. The separated, spent catalyst is then stripped of occluded hydrocarbons with steam in a stripping zone at the bottom of the reactor and the stripped catalyst is sent to a regenerator in which the carbon (i.e., coke) which accumulates on the catalyst as a result of the carbon rejection reactions taking place during the cracking process is oxidatively combusted to reactivate the catalyst and to supply the heat for the endothermic cracking reactions. The hot catalyst from the regenerator is then recirculated to the risers to participate in another round of cracking.

Various known FCC catalysts may be employed in the FCC unit. FCC catalysts may be amorphous, e.g., silica-alumina, crystalline, e.g., molecular sieves including zeolites, or mixtures thereof. A preferred catalyst particle comprises (a) an amorphous, porous solid acid matrix, such as alumina, silica-alumina, silica-magnesia, silica-zirconia, silica-thoria, silica-beryllia, silica-titania, silica-alumina-rare earth and the like; and (b) a zeolite. The matrix can comprise ternary compositions, such as silica-alumina-thoria, silica-alumina-zirconia, magnesia and silica-magnesia-zirconia. Silica-alumina is particularly preferred for the matrix, and can contain about 10 to 60 wt. % alumina. Promoters can also be added.

The amount of zeolite component in the catalyst particle will generally range from about 1 to about 60 wt. %, preferably from about 5 to about 60 wt. %, and more preferably from about 10 to about 50 wt. %, based on the total weight of the catalyst. As discussed, the catalyst is typically in the form of a catalyst particle contained in a composite. The catalyst may include ReY, ReUSY, HY, or any faujasite framework type zeolite. The cracking catalyst may include a medium pore zeolite having a Constraint Index (which is defined in U.S. Pat. No. 4,016,218) of about 1 to about 12. Suitable medium pore zeolites include ZSM-5, ZSM-11, ZSM-12, ZSM-22, ZSM-23, ZSM-35, ZSM-48, ZSM-57, SH-3 and MCM-22, either alone or in combination. Preferably, the medium pore zeolite is ZSM-5.

Although the present disclosure focuses primarily on the use of a side riser to an FCC to dehydrogenate the paraffin feed, in some embodiments the dehydrogenation of the paraffin feed could be conducted in the main riser of a repurposed or standalone FCC dehydrogenation unit.

In yet another embodiment, a fluidized coking process, such as a FLEXICOKING™ process, could be used in place of an FCC as the heat engine for the process. Hot coke can be pulled from the heater or gasifier. Gasifier coke may form isobutylene more selectively than FCC catalyst due to metals buildup and the absence of acid sites.

Side Riser Conditions

In any embodiment, the side riser may operate under conditions suitable for dehydrogenating the paraffin feed to produce an olefin-containing product. For the dehydrogenation of butane, operating temperatures between about 1100° F. and about 1400° F., such as between about 1200° F. and about 1300° F. at a pressure of about 1 bar to about 3 bar, such as about 2 bar, for a contact time of about 0.5 seconds to about 4 seconds, such as about 1 second to about 2 seconds may be employed.

At such temperatures, thermal catalysis involving radical chemistry occurs. For example, hydrogen abstraction from isobutane results in a tertiary or primary radical. Beta scission of the tertiary radical leads to isobutylene since there are only hydrogens in the beta-position and the less stable primary radical undergoes a beta-scission reaction to propylene and a methyl radical. In the case of the primary radical, C—C bond breaking is favored over C—H bond breaking due to a lower activation barrier and higher pre-exponential. Isobutane dehydrogenation equilibrium conversion is about 90% at 1250° F. but falls off quickly at lower temperature. Low pressure also improves the equilibrium conversion. The cracking of butane to propylene and methane does not result in the liberation of H2 and does not face the same equilibrium limitation.

One possible embodiment to upgrade light paraffins involves injecting the paraffin ahead of the main oil injection zone in an FCC riser. However, comingling of the streams can lead to undesired hydrogen transfer reactions, leading to reduced olefinicity in the product and higher coking. The olefin product and heavy naphthenic components in the primary riser feed can react to produce paraffins and aromatics. If the heavy stream consists essentially of aromatics, hydrogen transfer may be minimized, enabling co-processing without adverse effects. Coke formation releases hydrogen, which can have a deleterious effect on the olefin-paraffin equilibrium. In addition to avoiding hydrogen transfer reactions, a separate stream increases concentration for recovery and avoids separating a complex mixture.

The use of a separate side riser allows for optimized processing of heavy and light feeds to simultaneously produce products that are heavier and lighter than gasoline. Higher catalyst-to-oil ratios in a separate riser can be used to maintain a high temperature and short contact time operation minimizes coking. The solid catalyst acts as a high surface area heat transfer medium and coke buildup is burned off in the regenerator. Shared regeneration facilitates heat balancing of the FCC with isobutane feeds producing insufficient coke and heavy feeds producing excess coke. The amount of heat transferred is the product of the catalyst circulation, heat capacity of the catalyst and temperature drop across the riser.

Catalyst may be lifted into and through the side riser with steam or feed. The catalyst may be stripped before exiting the regenerator using nitrogen and fuel. Steam can be injected to adjust the inlet temperature, steam to hydrocarbon ratio, and control residence time. The addition of steam can help convert coke to COx in the side riser. Using the catalyst as the source of heat avoids the large steam co-feed needed to prevent coking on steam cracker furnace tubes as coke preferentially builds on the hot surface of the catalyst rather than the reactor walls. Alternatively, the butane feed can facilitate catalyst fluidization in place of steam. Since dehydrogenation is equilibrium-limited, plug flow gas movement leads to a higher per pass conversion.

The catalyst employed can impact the products of the side riser. Acid sites catalyze cracking reactions to form smaller molecules and can break up oligomers on the surface. Fresh catalyst leads to more cracking than the same spent catalyst. Catalyst compositions that minimize the use of phosphate and rare earth stabilizers have lower hydrogen transfer properties and improved olefin yields. Without being bound by theory, it is believed that ZSM-5 preferentially acts on propane and normal paraffins since isobutane is sterically hindered. Advantageously, the side riser provides a flexible disposition for light molecules and is robust to impurities.

Dehydrogenation to butylene is typically preferred over cracking to propylene. Acid/metal functionality can tune the propylene to butylene ratio and additives can curb acidity. High Ni and V loadings may be beneficial for dehydrogenation, while low Ni and V loadings may be beneficial for cracking to propylene. The presence of Ni inside the zeolite pores can catalyze dehydrogenation of light paraffins while avoiding undesired reactions of heavy molecules leading to coke and dry gas. Side riser operation is favored under low acid, high metals conditions typical of processing residual oils in the main riser. Low rare earth and 0.8 to 3 wt % carbon are preferred.

Injecting a coke precursor on the catalyst prior to contacting isobutane can block the external or highest activity acid sites on the catalyst and favor dehydrogenation over cracking yields. The heavy feed could pre-reduce the catalyst, provide C/H synergy when processing hydrogen-rich and hydrogen-deficient feeds together, and promote radical dehydrogenation reactions. A frustum (expended region) at the base of the FCC riser may be employed to provide longer residence times as well as complete mixing and uniform temperature. Partial burn regeneration provides an opportunity to tailor the surface carbon allowing for adjusting to different feeds and catalyst deactivation rates. Removing the catalyst from the side of the regenerator can lead to incomplete regeneration carbon removal.

Furthermore, it is possible to tune the propylene to butylene product distribution through reaction conditions. In general, the product distributions produce higher yields of butylenes relative to propylene and isobutylene is favored over propylene at lower temperature. There is a tradeoff in compressor load between increased recycle of unreacted isobutane at low side riser conversion and higher dry gas rates due to lower selectivity at high conversion. Yields for the side riser processing a 100 wt % isobutane feed are exemplified in Table 1 below.

TABLE 1

Side riser data for 100 wt % isobutane feed

| | Isobutane conversion [%] | | | |
|---|---|---|---|---|
| Selectivity [wt %] | 35 | 40 | 45 | 50 |
| Coke | 0.4 | 0.5 | 0.5 | 0.6 |
| Methane | 15.3 | 16.1 | 17.0 | 17.8 |
| Ethylene | 2.2 | 2.6 | 2.9 | 3.2 |
| Ethane | 0.7 | 0.8 | 0.9 | 1.0 |
| Propylene | 31.8 | 31.6 | 31.4 | 31.2 |
| Propane | 0.5 | 0.6 | 0.7 | 0.7 |
| Isobutylene | 40.1 | 37.7 | 35.3 | 32.9 |
| 1-Butene | 1.1 | 1.1 | 1.1 | 1.1 |
| 1,3-Butadiene | 0.3 | 0.4 | 0.4 | 0.5 |
| n-Butane | 0.4 | 0.4 | 0.3 | 0.2 |
| T-2-Butene | 2.1 | 2.0 | 1.9 | 1.8 |
| C-2-Butene | 2.0 | 1.9 | 1.8 | 1.7 |
| $C_5$+ | 4.3 | 4.9 | 5.5 | 6.1 |
| Hydrogen | 1.6 | 1.6 | 1.5 | 1.5 |

Gas-phase products may be quickly separated from the solid catalyst in an external cyclone. Gas out of the top of the cyclone can enter the reactor headspace to utilize existing secondary cyclones for fines removal or the gas can be sent to a heat exchanger followed by a wash with water and/or a heavy oil, e.g. VGO or MTB. The product can pass through a tower gas-gas heat exchanger to preheat the isobutane feed or a liquid-gas heat exchanger to preheat the main FCC feed. Alternatively, the product can indirectly heat the FCC feed using steam as an intermediary heating media. Spent catalyst can be put into the regenerator or into the main riser standpipe since the coke loading may be very low (for example, if the catalyst is not pre-coked). Feeding the hot catalyst into the regenerator primary cyclone inlets improves hot stripping and decreases coke make, but may exceed the temperature limits of traditional stripper internals and may necessitate a spent catalyst distributor to facilitate even distribution of coke within the regenerator and preclude air from entering the hydrocarbon section.

Feeding the side riser spent catalyst to the main riser standpipe drops the temperature of the main riser inlet, allowing for higher catalyst circulation rates and more fresh acid sites. As another option, the spent catalyst could be reheated with natural gas and sent directly back to the side riser with only a slipstream going to the regenerator to remove accumulated coke. The gas effluent may contain small fines that are recovered in a gas oil or water wash.

Separation

As shown in Table 1, light gases (ethane and lighter) and propylene are products that may be found in the olefin-containing product stream exiting the side riser. In any embodiment, it may be desirable to separate light gases (e.g., ethane and lighter) and/or propylene from the product stream of the side riser. In some embodiments, propylene may be separated from the olefin-containing product stream, and, in other embodiments, propylene may be fed with other olefins to an alkylation or oligomerization unit.

In any embodiment, the pressure of the olefin-containing product stream can be raised to 250-300 psig using one or more, preferably, 2 to 3, stages of compression with inter-stage cooling. A large portion of the butane may liquefy during stage two, allowing for use of a pump to make up the difference. Ethane may be removed using a deethanizer adsorption tower or a refrigerated distillation column to achieve a purely liquid phase and enable pumping while retaining the propylene. Any entrained H2S and non-condensable gases can exit in the deethanizer. Vaporization of the fresh isobutane feed to FCC pressure can provide refrigeration needed in reflux condensers.

A sponge oil may be used to allow for the separation of ethane to be performed at temperatures greater than 100° F. so that it is possible to use cooling water rather than refrigeration. In any embodiment, recycled alkylate or a heavy portion of alkylate can serve as sponge oil. Alkylate preferably contains no olefins or aromatics that can randomly alkylate, allowing it to pass through the reactor. An additional heavy oil (e.g., VGO) contacting step can be applied to the off-gas after an alkylate-contacting step to recover any alkylate. The deethanizer reboiler sets the $C_2$— in the olefin product so that the product remains a liquid after fractionation. The addition of a side cooler can ensure the top trays remain cool and improve the separation. The use of an adsorption liquid avoids the need for complete drying of the feed to prevent ice formation.

In any embodiment, vacuum gas oil (VGO), main tower bottoms (MTB), or a solvent extracted portion of such streams may be used as a deethanizer sponge wash and has several advantages. MTB as a sponge oil avoids loss out of the deethanizer due to its low volatility, is easy to separate from butanes, and can be combined with bottoms recycle. When the sponge oil is recycled to the main riser, any light gas trapped in the heavy oil is recovered in the main fractionation system and helps with the main riser carbon/hydrogen balance. If recycled to the side riser, MTB is already almost fully aromatic thereby minimizing hydrogen transfer reactions and can also be used to pre-coke the catalyst in order to reduce acidity.

Separation of the deethanizer liquid product into a butane rich phase and sponge oil can also be accomplished via supercritical phase separation or other phase separation of the heavy sponge oil and the butane that avoids the heat input and removal corresponding to the latent heat of vaporization. The sponge oil can be recycled back to the top of the deethanizer tower or fed to the FCC main riser in order to maintain absorption capacity through influx of fresh sponge oil.

Alkylation/Oligomerization

Alkylation or oligomerization can convert the olefin product to fuels. Alkylation may be preferred because it creates an additional light isoparaffin uplift per olefin, making it more olefin efficient and consequently energy efficient than oligomerization. High alkylation yields also increase the overall carbon efficiency. In addition, the isoparaffin product may have reduced olefinicity, avoiding the need for hydrotreating and has higher octane than normal paraffins.

Various catalysts may be used for alkylation, including liquid acid catalysts (such as sulfuric acid or hydrofluoric acid) and solid acid catalysts. In some embodiments, alkylation may be performed with sulfuric acid. Sulfuric acid alkylation units operate more favorably with butylene rather than propylene feeds due to the formation of propyl sulfate intermediates when alkylating propylene that decrease acid strength. In embodiments, sulfuric acid alkylation units can be utilized with a high propylene content feed by separating the feed into propylene-rich and butylene-rich feeds. In such embodiments, the propylene-rich feed may be injected via a separate alkylation nozzle or reactor before the butylene-rich feed, which converts propyl sulfate intermediates to alkylate, thereby washing the acid phase, restoring acid strength and improving product quality.

Conditions for alkylation of olefinic feeds with a liquid acid catalyst are affected by the type of liquid acid catalyst used and the feed composition. In general, alkylation is exothermic and sulfuric acid alkylation may be run under refrigerated conditions. Alkylation of 2-butene as opposed to 1-butene produces higher octane alkylate, and the thermodynamic equilibrium favors 2-butene at lower temperature. Cyclopentene, ethylene, diolefins and other impurities cause increased acid consumption. For isobutene feeds with sulfuric acid catalyst, alkylation generally may be achieved at a temperature of about 10° C., 10-60 psig, and an isobutane to olefin (i/o) ratio (measured in volume isobutane/volume olefin) of about 4 to about 8 and 0.1 to 0.3 h−1 olefin liquid hourly space velocity (OLHSV).

Simulation results showing product yields for alkylation of the product stream of Table 1 with the separation of ethane, but without the separation of propylene is illustrated in Table 2. These results are derived from a process model incorporating isobutane recycle.

TABLE 2

Pure sulfuric acid alkylation case (without propylene separation)

| | Isobutane conversion [%] | | | |
|---|---|---|---|---|
| | 35 | 50 | 35 | 50 |
| | Yield wt % | | Yield liq. vol % | |
| F.G. | 13.1 | 16.5 | n.d. | n.d. |
| $C_5$+ | 89.9 | 83.5 | 71.4 | 66.3 |
| ON [(R + M)/2] | 89.9 | 89.7 | 89.9 | 89.7 |
| RVP [psi] | 3.1 | 3.2 | 3.1 | 2.6 |

In addition to the unreacted isobutane being taken up in the alkylation unit and product separation as alkylate, chemical grade propylene can be produced from isobutane without propylene/propane separation, which would require significant reflux and many separation stages. This results from the fact that propylene is a primary product while propane is a secondary product and there is little propane to begin with. It is possible to increase propylene production through increased heat addition to the riser and higher conversion. By letting some of the propylene slip into the alkylation feed, it is possible to minimize the $C_4$ and propane content in the propylene product. A process configuration with propylene separation is shown in FIG. 1. Simulation results showing product yields for the process of FIG. 1 (i.e., with the separation of propylene) is illustrated in Table 3. These results are derived from a process model incorporating isobutane recycle.

TABLE 3

Sulfuric acid alkylation with propylene separation

| | Isobutane conversion [%] | | | |
|---|---|---|---|---|
| | 35 | 50 | 35 | 50 |
| | Yield wt % | | Yield liq. vol % | |
| F.G. | 16.4 | 22.2 | n.d. | n.d. |
| $C_3$= | 21.0 | 21.6 | 22.7 | 23.4 |
| $C_5$+ | 62.6 | 56.2 | 49.7 | 44.6 |
| ON [(R + M)/2] | 92.1 | 91.6 | 92.1 | 92.0 |
| RVP [psi] | 2.6 | 2.6 | 2.6 | 2.6 |

As mentioned previously, solid acid catalysts may also be employed in the alkylation unit. Solid acids, as used herein, generally refer to catalyst particles that possess acidic properties on their surface. In general terms, a solid acid adsorbs basic molecules and changes the color of a basic indicator. An acid has a tendency to donate a proton according to the Brønsted definition and a tendency to accept an electron pair according to the Lewis definition. Without being bound by theory it is believed that isobutane alkylation can be catalyzed by strong Lewis acids by abstracting a H— from isobutane to form an activated t-butyl cation which alkylates with an olefin. In contrast a Brønsted acid will protonate (activate) the olefin which goes on to alkylate with isobutane. Various solid acid catalysts may be employed including amorphous (e.g., silica-alumina), crystalline (e.g., molecular sieves including zeolites) or mixtures of such particles having acid sites.

Solid acid alkylation catalysts tend to have lower activity than liquid alkylation systems and will therefore generally require operating at higher temperatures than liquid acid catalysts to increase activity. The resulting space velocities of alkylation may require increasing the density of the feed through increased pressure. The specific conditions required for alkylation with solid acid catalysts will vary depending on the specific catalyst and feed composition and can include supercritical conditions.

Solid acid alkylation catalysts are more resistant to water and have olefin feed flexibility but are sensitive to basic nitrogen in the feed. Isobutene is very reactive, making it prone to oligomerization. Solid acid alkylation uses higher isobutane to olefin (i/o), ratios to minimize oligomerization of olefins. In order to increase the isobutane to olefin ratio, alkylation systems may employ a mixture of reactor effluent recycle and multiple reaction stages with separate olefin injection. Thus, the local i/o can be higher than the external i/o ratio around the reactor. Unlike sulfuric acid alkylation, solid acid alkylation catalyzes propane formation through hydrogen transfer.

Isobutane may be recycled to the alkylation reactor to maintain the high i/o ratio and a slipstream can return to the side riser to generate more olefins. In any embodiment, the side riser may operate at approximately 50% conversion rates, which produces a stoichiometric mix of olefin and isoparaffin and renders a recycle stream to the side riser unnecessary. The higher temperatures of solid acid alkylation relative to sulfuric acid alkylation advantageously may lead to better temperature overlap with the side riser. Ethylene may be a poison for sulfuric acid alkylation units but produces high octane, moderate RVP alkylate with solid acid alkylation, though activity is low.

The integration of a side riser and alkylation system provides a double light paraffin uplift to liquid fuels and has a number of other advantages. Propane from the alkylation separation can be recycled to the deethanizer top to minimize loss of propylene. This alters the liquid composition, leading to a lower propylene vapor pressure and less propylene losses with the high ethane rate. The significant thermal catalysis in the side riser prevents the buildup of less reactive normal paraffins in the side riser-alkylation recycle such as propane and normal butane and allows recycling of a mixed paraffin stream. Normal butane can be taken as a side draw on the deisobutanizer or recycled to the side riser and reacted away. Incorporation of normal butane isomerization can further improve side riser yields. Allowing these components to flow back to the side riser avoids a depropanizer/isostripper and loss of isobutane when separating out propane and normal butane. In the case of low i/o, effluent recycle can provide a sponge oil while avoiding boiling the butane off the alkylate.

In yet another embodiment, it is also possible to send the entire side riser product through the alkylation unit without upstream separation to avoid losing propylene in the deethanizer and then separate $C_3$ and lighter hydrocarbons from the butane and alkylation product. This removes the need for a deethanizer and allows for moderate reflux condenser temperatures. In the case of solid acid alkylation, it may also be possible to do ethylene alkylation.

ADDITIONAL SPECIFIC EMBODIMENTS

Embodiment 1

A method of producing gasoline boiling range hydrocarbons from light paraffins comprising: exposing a paraffin-containing stream to a catalyst in a side riser of a fluid catalytic cracking reactor under effective conditions for dehydrogenating at least a portion of paraffins in the stream into olefins and thereby producing an olefin-containing stream, wherein the paraffin-containing stream comprises greater than 50 wt % isobutane; and alkylating olefins in the olefin-containing stream, without intermediate separation of unreacted isobutane in the olefin-containing stream, to produce a product stream comprising an alkylate fraction comprising hydrocarbons boiling between 100° F. and 400° F.

Embodiment 2

The method of any other enumerated Embodiment, wherein the effective conditions comprise conditions suitable for achieving a propylene:propane weight ratio of at least 40:1.

Embodiment 3

The method of any other enumerated Embodiment, wherein the propylene:propane weight ratio is about 50:1 or greater.

Embodiment 4

The method of any other enumerated Embodiment, further comprising separating propylene from the olefin-containing stream prior to the step of alkylating olefins in the olefin-containing stream.

Embodiment 5

The method of any other enumerated Embodiment, further comprising separating ethane from the olefin-containing stream prior to the step of alkylating olefins.

Embodiment 6

The method of any other enumerated Embodiment, further comprising recycling at least a portion of the alkylate fraction and combining the at least a portion of the alkylate fraction with the olefin-containing stream prior to or concurrently with the step of separating ethane.

Embodiment 7

The method of any other enumerated Embodiment, further comprising diverting at least a portion of the main riser feed or a solvent extracted portion of the feed and combining the at least a portion of the main riser fraction with the olefin-containing stream prior to or concurrently with the step of separating ethane.

Embodiment 8

The method of any other enumerated Embodiment, further comprising separation of the deethanizer liquid product into a butane rich phase and sponge oil via supercritical phase separation or other phase separation of the heavy sponge oil and the butane that avoids the heat input and removal corresponding to the latent heat of vaporization. In an embodiment, the FCC feed may be the paraffinic portion of solvent extracted FCC feed. The sponge oil may be recycled back to the top of the deethanizer tower or fed to the FCC main or side risers in order to maintain absorption capacity through influx of fresh sponge oil.

Embodiment 9

The method of any other enumerated Embodiment, further comprising operation of the alkylation reactor in the supercritical region.

Embodiment 10

The method of any other enumerated Embodiment, wherein the catalyst is fed to the side riser after regeneration in a regenerator receiving spent catalyst utilized in a main riser of the fluid catalytic cracking reactor.

Embodiment 11

The method of any other enumerated Embodiment, further comprising pre-coking the catalyst in order to tune the catalytic activity. As one potential embodiment this can involve feeding a heavy feed ahead of the isobutane in the riser.

Embodiment 12

The method of any other enumerated Embodiment, further comprising cracking a feed of a vacuum gas oil in the main riser.

Embodiment 13

The method of any other enumerated Embodiment, wherein the step of alkylating olefins is performed by contacting the olefin-containing stream with an acid catalyst.

Embodiment 14

The method of any other enumerated Embodiment, wherein the acid catalyst is a liquid catalyst.

Embodiment 15

The method of any other enumerated Embodiment, wherein the acid catalyst is a solid catalyst.

Embodiment 16

The method of any other enumerated Embodiment, wherein a normal butane feed stream is passed over a catalyst suitable for isomerizing it to an equilibrium or near-equilibrium mixture of normal and isobutane and the mixture is fed to the side riser without separation of the normal and isobutane.

Embodiment 17

The method of any other enumerated Embodiment, wherein a normal butane side stream from the alkylation reactor is isomerized and fed to the side riser.

Embodiment 18

A method of producing gasoline boiling range hydrocarbons from light paraffins comprising: exposing a residual fraction to a catalyst in a main riser of a fluid catalytic cracking reactor under first effective conditions to crack hydrocarbons of the residual fraction; exposing a paraffin-containing stream to the catalyst in a side riser of the fluid catalytic cracking reactor under second effective conditions for dehydrogenating at least a portion of paraffins in the stream into olefins and thereby producing an olefin-containing stream, wherein the paraffin-containing stream comprises greater than 50 wt % isobutane; and alkylating olefins in the olefin-containing stream to produce a product stream comprising an alkylate fraction comprising hydrocarbons boiling between 100° F. and 400° F.

Embodiment 19

The method of any other enumerated Embodiment, wherein the olefins in the olefin-containing stream are alkylated without intermediate separation of unreacted isobutane in the olefin-containing stream.

Embodiment 20

The method of any other enumerated Embodiment, further comprising separating propylene from the olefin-containing stream prior to the step of alkylating olefins in the olefin-containing stream.

Embodiment 21

The method of any other enumerated Embodiment, wherein the catalyst is fed to the side riser after regeneration in a regenerator receiving spent catalyst utilized in the main riser of the fluid catalytic cracking reactor.

Embodiment 22

The method of any other enumerated Embodiment, further comprising pre-coking the catalyst in order to tune the catalytic activity. As one potential embodiment this can involve feeding the heavy feed ahead of the isobutane.

Embodiment 23

A method of producing gasoline boiling range hydrocarbons from light paraffins comprising: Contacting a paraffin-containing stream with a gas oil feed in order to extract paraffinic components via subcritical phase separation; exposing the paraffin-containing stream to the catalyst in a side riser of the fluid catalytic cracking reactor under effective conditions for generating olefins and thereby producing an olefin-containing stream, wherein the paraffin-containing stream comprises greater than 50 wt % isobutane; and alkylating olefins in the olefin-containing stream to produce a product stream comprising an alkylate fraction comprising hydrocarbons boiling between 100° F. and 400° F.

Embodiment 24

A method of producing gasoline boiling range hydrocarbons from light paraffins comprising: exposing a paraffin-containing stream to a catalyst in a side riser of a fluidized coker under effective conditions for dehydrogenating at least a portion of paraffins in the stream into olefins and thereby producing an olefin-containing stream, wherein the paraffin-containing stream comprises greater than 50 wt % isobutane; and alkylating olefins in the olefin-containing stream, without intermediate separation of unreacted isobutane in the olefin-containing stream, to produce a product stream comprising an alkylate fraction comprising hydrocarbons boiling between 100° F. and 400° F.

The invention claimed is:

1. A method of producing gasoline boiling range hydrocarbons from light paraffins comprising:

providing a fluid catalytic cracking reactor having a main riser and a side riser and a regenerator wherein the main riser and the side riser operate in parallel and both the main riser and the side riser receive a regenerated catalyst from the regenerator;

exposing a parrafin-containing stream to the regenerated catalyst in the side riser of the fluid catalytic cracking reactor under effective conditions for dehydrogenating at least a portion of paraffins in the stream into olefins and thereby producing an olefin-containing stream, wherein the paraffin-containing stream comprises greater than 50 wt % isobutane and such that the side riser acts as a coolant for the regenerated catalyst; and alkylating olefins in the olefin-containing stream, without intermediate separation of unreacted isobutane in the olefin-containing stream, to produce a product stream comprising an alkylate fraction comprising hydrocarbons boiling between 100° F. and 400° F.

2. The method of claim 1, wherein the effective conditions comprise conditions suitable for achieving a propylene: propane weight ratio of at least 40:1.

3. The method of claim 2, wherein the propylene:propane weight ratio is about 50:1 or greater.

4. The method of claim 2, further comprising separating propylene from the olefin-containing stream prior to the step of alkylating olefins in the olefin-containing stream.

5. The method of claim 1, further comprising separating ethane from the olefin-containing stream prior to the step of alkylating olefins.

6. The method of claim 5, further comprising recycling at least a portion of the alkylate fraction and combining the at least a portion of the alkylate fraction with the olefin-containing stream prior to or concurrently with the step of separating ethane.

7. The method of claim 1, wherein the catalyst is fed to the side riser after regeneration in a regenerator receiving spent catalyst utilized in the main riser of the fluid catalytic cracking reactor.

8. The method of claim 1, further comprising cracking a feed of a vacuum gas oil in the main riser.

9. The method of claim 1, wherein the step of alkylating olefins is performed by contacting the olefin-containing stream with an acid catalyst.

10. The method of claim 9, wherein the acid catalyst is a liquid catalyst.

11. The method of claim 9, wherein the acid catalyst is a solid catalyst.

12. A method of producing gasoline boiling range hydrocarbons from light paraffins comprising:

providing a fluid catalytic cracking reactor having a main riser and a side riser and a regenerator wherein the main riser and the side riser operate in parallel and both the main riser and the side riser receive a regenerated catalyst from the regenerator;

exposing a residual fraction to a catalyst in the main riser of a fluid catalytic cracking reactor under first effective conditions to crack hydrocarbons of the residual fraction;

exposing a paraffin-containing stream to the catalyst in the side riser of the fluid catalytic cracking reactor under second effective conditions for dehydrogenating at least a portion of paraffins in the stream into olefins and thereby producing an olefin-containing stream, wherein the paraffin-containing stream comprises greater than 50 wt % isobutane and such that the side riser acts as a coolant for the regenerated catalyst; and alkylating olefins in the olefin-containing stream to produce a product stream comprising an alkylate fraction comprising hydrocarbons boiling between 100° F. and 400° F.

13. The method of claim 12, wherein the olefins in the olefin-containing stream are alkylated without intermediate separation of unreacted isobutane in the olefin-containing stream.

14. The method of claim 12, wherein the second effective conditions comprise conditions suitable for achieving a propylene:propane weight ratio of at least 40:1.

15. The method of claim 14, wherein the propylene: propane weight ratio is about 50:1 or greater.

16. The method of claim 12, further comprising separating propylene from the olefin-containing stream prior to the step of alkylating olefins in the olefin-containing stream.

17. The method of claim 12, further comprising separating ethane from the olefin-containing stream prior to the step of alkylating olefins.

18. The method of claim 17, further comprising recycling at least a portion of the alkylate fraction and combining the at least a portion of the alkylate fraction with the olefin-containing stream prior to or concurrently with the step of separating ethane.

19. The method of claim 12, wherein the catalyst is fed to the side riser after regeneration in a regenerator receiving spent catalyst utilized in the main riser of the fluid catalytic cracking reactor.

20. The method of claim 12, wherein the step of alkylating olefins is performed by contacting the olefin-containing stream with an acid catalyst.

21. The method of claim 20, wherein the acid catalyst is a liquid catalyst.

22. The method of claim 20, wherein the acid catalyst is a solid catalyst.

* * * * *